US007713920B2

(12) United States Patent
Ford et al.

(10) Patent No.: US 7,713,920 B2
(45) Date of Patent: May 11, 2010

(54) DETERGENT COMPOSITIONS CONTAINING AZO INITIATOR COMPOUNDS FOR IMPROVED BLEACHING PERFORMANCE AND STAIN-REMOVAL BENEFITS

(75) Inventors: Francis Cornelio Ford, Cincinnati, OH (US); Peter Robert Foley, Cincinnati, OH (US); Alan David Willey, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 471 days.

(21) Appl. No.: 11/639,002

(22) Filed: Dec. 14, 2006

(65) Prior Publication Data

US 2007/0135330 A1 Jun. 14, 2007

Related U.S. Application Data

(60) Provisional application No. 60/750,235, filed on Dec. 14, 2005.

(51) Int. Cl.
*C11D 3/26* (2006.01)

(52) U.S. Cl. ..... 510/220; 510/221; 510/226; 510/233; 510/235; 510/237; 510/243; 510/514

(58) Field of Classification Search ..... 510/220, 510/221, 226, 233, 235, 237, 243, 514
See application file for complete search history.

(56) References Cited

U.S. PATENT DOCUMENTS

| | | | | |
|---|---|---|---|---|
| 6,150,430 | A * | 11/2000 | Walters et al. | 522/79 |
| 6,207,631 | B1 * | 3/2001 | Kasturi et al. | 510/237 |
| 6,551,411 | B1 * | 4/2003 | Ito et al. | 134/9 |
| 6,849,591 | B1 * | 2/2005 | Boeckh et al. | 510/475 |
| 2003/0203825 | A1 * | 10/2003 | Aubay | 510/220 |
| 2005/0164898 | A1 * | 7/2005 | Kasturi et al. | 510/237 |
| 2005/0277571 | A1 * | 12/2005 | Choi et al. | 510/499 |
| 2006/0148668 | A1 * | 7/2006 | Verrall et al. | 510/293 |
| 2008/0035885 | A1 * | 2/2008 | Hage et al. | 252/186.24 |
| 2008/0281053 | A1 * | 11/2008 | Baum et al. | 525/451 |

OTHER PUBLICATIONS www.wako-chem.co.jp/specialty/oilazo/V-30.htm.*

* cited by examiner

*Primary Examiner*—Charles I Boyer
(74) *Attorney, Agent, or Firm*—Idris N. McKelvey; Laura R. Grunzinger; Kim W. Zerby

(57) ABSTRACT

Detergent compositions containing azo initiator compounds are provided. More particularly, detergent compositions containing azo initiator compounds having improved bleaching performance and stain-removal benefits, and methods of using the same, are provided. Composition of matter and articles of manufacture are also provided.

20 Claims, No Drawings

DETERGENT COMPOSITIONS CONTAINING AZO INITIATOR COMPOUNDS FOR IMPROVED BLEACHING PERFORMANCE AND STAIN-REMOVAL BENEFITS

CROSS REFERENCE TO RELATED APPLICATION

This application claims the benefit of the filing date of U.S. Provisional Patent Application No. 60/750,235, filed Dec. 14, 2005, the disclosure of which is incorporated by reference herein.

FIELD OF THE INVENTION

The present invention relates to detergent compositions containing an azo initiator compound. More particularly, the invention is directed to detergent compositions containing azo initiator compounds having improved bleaching performance and stain-removal benefits, and methods of using the same. Composition of matter and articles of manufacture are also provided.

BACKGROUND OF THE INVENTION

Azo initiator compounds represent an important class of free-radical initiating agents that are used in a variety of industrial applications such as vinyl polymerizations, graft polymerizations, halogenations, and as blowing agents. With respect to peroxide based initiators, azo initiator compounds display consistent decomposition behavior, less color formation, and a higher degree of safety.

Azo initiator compounds can be either symmetrical or asymmetrical about the azo linkage. Symmetrical azo initiators of commercial interest are generally solid and have low to medium solubility in organic solvents. Asymmetrical azo initiators, by contrast, are often low melting point solids with higher solubilities in organic solvents.

It has been found that the azo initiator compounds described herein may be useful as stain removers detergent compositions such as light-duty liquid detergents, automatic dishwashing detergents, hard surface cleaners, rinse aid compositions, and in heavy-duty liquid detergents, such as fabric spot removers/cleaners. They may also be incorporated into a fast setting spray and peel product for peel off removal of red (e.g., carotene) stains on plastic, which may be used in conjunction with foaming agents or special packaging to deliver a foaming stain remover/deodorizer.

SUMMARY OF THE INVENTION

The present invention relates to a detergent composition comprising: (a) an azo initiator compound having one or more of the following formulas:

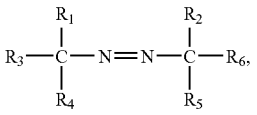

(I)

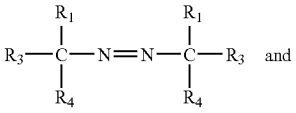

(I′)

-continued

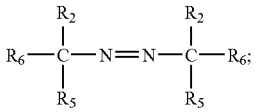

(I″)

(b) a detergent active; and (c) optionally an adjunct ingredient; wherein functional groups $R_1$ and $R_2$ are independently either H, a hydrocarbyl, an electron releasing group (or "ERG"), or an electron withdrawing group (or "EWG"); wherein functional groups $R_3$, $P_4$, $R_5$, and $R_6$ are independently either H or a hydrocarbyl; and wherein when paired, functional groups $R_3$ and $R_4$ and/or $R_5$ and $R_6$ independently comprise at least about 10 carbon atoms. The detergent composition may, for example, comprise, by weight: (a) at least about 0.1% of an azo initiator compound having one or more of the above formulas: (I), (I′) and (I″); (b) from about 0.0001% to about 99.9% of a detergent active; and (c) optionally, an adjunct ingredient.

DETAILED DESCRIPTION

The present invention relates to a detergent composition comprising an azo initiator compound.

By "compact" refers to a detergent formulation with reduced levels of water compared to conventional detergent formulations. The level of water is less than about 50%, and alternatively, less than about 30% by weight of the detergent compositions. Compact granules have densities ranging from about 480-520 g/L. Compact liquids may have densities between about 1-1.4 g/mL. Compact products may be used in lower amounts, which can translate into lower handling and shipping costs for the manufacturer.

The phrase "effective amount" is defined as that amount of a compound (e.g. detergent active, such as surfactants, builders, and enzymes) in a detergent composition, which is effective for achieving an improvement in bleaching, cleaning, and/or stain-removal.

The term "hydrocarbon" as used herein is defined as a compound containing hydrogen and carbon only.

The phrase "hydrocarbon derivative" is defined as a compound derived from a hydrocarbon and comprises at least one heteroatom (i.e. an atom not including C or H).

The term "hydrocarbyl" as used herein is defined as a hydrocarbon or a hydrocarbon derivative. The hydrocarbyl may be branched, unbranched, substituted, unsubstituted, saturated, and/or unsaturated.

The term "hydrophobic" is defined as the tendency of a substance to repel water or to be incapable of completely dissolving in water. Hydrophobic substances, such as hydrocarbons are readily soluble in many non-polar solvents, such as octanol, but only sparingly soluble in water, a polar solvent.

The term "hydrophobicity" is defined as the association of non-polar groups or molecules in an aqueous environment, which arise from the tendency of water to exclude non-polar molecules.

The terms used herein are to be construed in a manner that is consistent with one skilled in the art. Any suitable source of standard art-recognized meanings may be used. A suitable non-limiting source may include, but is not limited to: Hawley's Condensed Chemical Dictionary, 13th Ed.

A. Azo Initiator Compound

Any suitable azo initiator compound may be used in any suitable amount in the detergent compositions described herein. In one non-limiting embodiment, the detergent composition comprises: (a) an azo initiator compound having one or more of the following formulas:

(I)

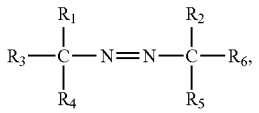

(I')

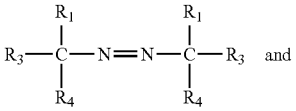

and (I")

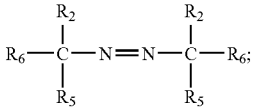

(b) a detergent active; and (c) optionally an adjunct ingredient; wherein functional groups $R_1$ and $R_2$ are independently either H (hydrogen), a hydrocarbyl, an electron releasing group, or an electron withdrawing group; wherein functional groups $R_3$, $R_4$, $R_5$, and $R_6$ are independently either H (hydrogen) or a hydrocarbyl; and wherein when paired, functional groups $R_3$ and $P_4$ and/or $R_5$ and $R_6$ independently comprise at least about 10 carbon atoms.

In another non-limiting embodiment, compound (I) may be asymmetrical. Asymmetry in compound (I) may be introduced into the azo initiator compound by introducing differences in the number of carbon atoms in the functional groups $R_3$, $R_4$, $R_5$, and/or $R_6$. For example, compound (I) may comprise functional groups $R_3$, $R_4$, $R_5$, and/or $R_6$ which may be selected from any suitable hydrocarbyl having any suitable number of carbon atoms. Suitable numbers of carbon atoms in the functional groups $R_3$ and $P_4$ and/or $R_5$ and $R_6$, when combined, may vary from about 10 to about any of the following: 12, 14, 16, 18, 20, 22, 24, or 30. Similarly, suitable numbers of carbon atoms of functional groups $R_3$ and $P_4$ and/or $R_5$ and $R_6$, when combined, may also vary from about any of the following: 10, 12, 14, 16, 18, 20, 22, or 24 to about 30.

In another non-limiting embodiment, compound (I) may include, but is not limited to: derivatized azoalkanes, such as azodicarboxylic esters or azodicarboxylic amides.

In another non-limiting embodiment, compounds (I) formed herein may be substantially free of the following functional groups: CN, $CO_2R$ (carboxylic ester), $CO_2H$ (acid), and $CO_2M$ (metal carboxylate), where R is a hydrocarbon with greater than one carbon atom and M is a metal.

In another non-limiting embodiment, the detergent composition may comprise one or more of the following azo initiator compounds: compound (I), compound (I'), and compound (I"), wherein compound (I) is asymmetrical. In another non-limiting embodiment, compound (I) comprises at least about any of the following: 1%, 5%, 10%, 15%, 20%, 30%, 40%, 50%, 60%, 70%, 80%, 90%, 99%, or 100% of the azo initiator compound present in the detergent composition.

While not wishing to be bound by theory, it is believed that during use of the detergent composition described herein, fragmentation of compound (I) into free-radicals occurs, wherein the electron releasing groups and/or electron withdrawing groups, when present, can act to delocalize the unpaired electron of the resulting radical over a larger area of space. As a result of such delocalization of the unpaired radical electron, the resulting radical is stabilized thereby extending the radical lifetime. It is also believed that the direct radical stabilization and lifetime extension effect of the ERGs and/or EWGs, when present, enhance the efficacy of compound (I) during use, which in turn promotes the bleaching performance and stain-removal benefits of the detergent composition for the uses described above.

Non-limiting examples of EWGs include, but are not limited to:

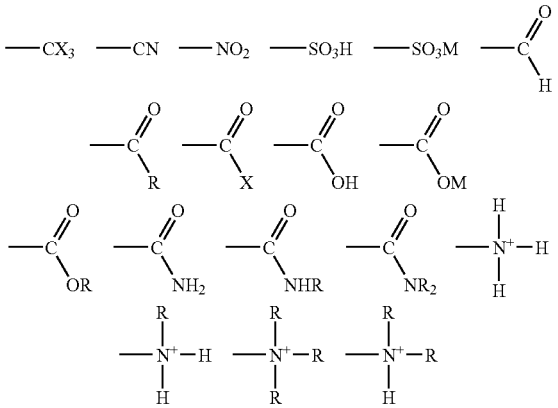

wherein R is a hydrocarbyl having greater than about 1 carbon atom; X is a halide; and wherein M is a metal.

Non-limiting examples of ERGs include, but are not limited to:

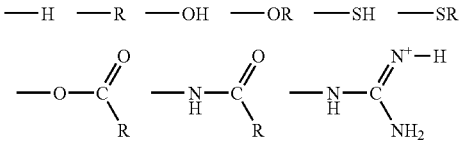

wherein R is a hydrocarbyl having greater than about 1 carbon atom; X is a halide; and wherein M is a metal.

In certain embodiments, compound (I) may comprise functional groups $R_1$ and $R_2$, when combined, may comprise from no (0) to about any of the following: 1, 2, 4, 6, 8, 10, 12, 14, 16, 18, 20, 22, 24, 26, or 30 carbon atoms.

The detergent composition may comprise at least about any of the following: 0.1%, 1%, 5%, 10%, 20%, 33%, 40%, 50%, 60%, 70%, 80%, or 90% of an azo initiator by weight of the detergent composition. Alternatively, a detergent composition may comprise an azo initiator compound described herein in an amount from about 0.1 to about any of the following: 90%, 80%, 70%, 60%, 50%, 40%, 30%, 20%, 15%, 10%, 7.5%, 5%, 3%, or 2% by weight of the detergent composition.

Octanol-Water Partition Coefficient (ClogP) of Azo Initiator Compound

The hydrophobicity of the compounds described herein may be a factor that can used to determine the relative efficacy of the azo initiator compound into the non-polar surface that is being treated. The octanol-water partition coefficient (ClogP) is the ratio of the concentration of a chemical compound in octanol versus its concentration in water at equilibrium and at a specified temperature. Octanol is an organic solvent that is used as a surrogate for natural-organic matter. The ClogP may be described by the following formula: ClogP=log $[C_O/C_W]$, wherein $C_O/C_W$ is the concentration of chemical compound in octanol ($C_O$) divided by the concentration of chemical compound in water ($C_W$). The ClogP can be related to the hydrophobicity of the azo initiator compounds described herein. While not wishing to be bound by theory, it is believed that the more hydrophobic the azo initiator compounds described herein, the more likely that it will be absorbed into non-polar organic matter, such as plastics, TUPPERWARE®, rubber and/or lipid-containing surfaces (e.g. fats and fatty soils).

For example, the ClogP may be used as a guide to predict the relative hydrophobicities of the azo initiator compounds described herein. The hydrophobic association of the azo initiator compounds described herein with natural-organic matter may be determined using the logarithm of the octanol-water ratio. Positive integers indicate that the compound or substance is highly hydrophobic, whereas negative numbers indicate a highly polar, water-soluble compound or substance. Some non-limiting examples are shown in the following Table I:

TABLE I

| CHEMICAL COMPOUND | ClogP |
|---|---|
| $H_2O$ | −1.380 |
| CH3—CH2—OH | −0.235 |
| 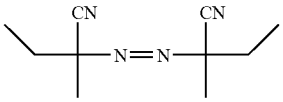 VAZO ® 67 | 1.145 |
| 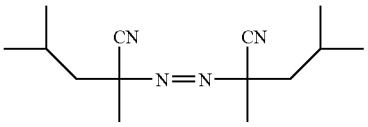 VAZO ® 52 | 1.328 |

The VAZO® series of free radical initiators are available from DuPont Chemicals of Wilmington, Del., U.S.A.

In certain embodiments, compound (I) may have a ClogP value of greater than about any of the following: 0.5, 1, 2, 3, 4, 5, 6, 7, 8, 9, or 10 to allow reasonable and/or effective absorption into non-polar surfaces.

In certain embodiments, the detergent composition may comprise azo initiator compounds comprising functional groups ($R_1$, $R_2$, $R_3$, $R_4$, $R_5$, and/or $R_6$), which may be used to control the hydrophobicity, as well as, the efficacy of absorption of the azo initiator compounds in a substrate surface that is treated with the detergent composition described herein.

Molecular Weight of the Azo Initiator Compound

The detergent compositions may comprise azo initiator compounds having any suitable molecular weight. The selection of specific functional groups (e.g. $R_1$, $R_2$, $R_3$, $R_4$, $R_5$, and/or $R_6$) may impact the actual molecular weight of the azo initiator compounds provided herein. Suitable molecular weights include, but are not limited to: from about 50 to about any of the following: 1,500, 1,000, 750, 500, 300, 200, or 150 grams/mole. In one non-limiting embodiment, the molecular weight may be from about 50 to about 500 grams/mole.

B. Detergent Active

By selecting the type and amount of detergent active, along with other optional adjunct ingredients disclosed herein, the detergent compositions can be formulated to be used in the context of automatic dishwashing detergents, rinse aids, hard surface cleaners, fabric or laundry cleaners and/or in other cleaning and/or bleaching applications, such as in spray and peel compositions and hand dishwashing compositions. The particular detergent actives used herein can therefore vary widely depending upon the particular end-use envisioned. Suitable amounts of a detergent active can include from about 0.0001% to about any of the following: 1%, 5%, 10%, 15%, 20%, 30%, 40%, 50%, 60%, 70%, 80%, 90%, 95%, or 99.9% by weight of the composition.

Surfactant System

The detergent compositions described herein may comprise any suitable surfactant system comprising any suitable surfactant in any suitable amount. Suitable surfactants include, but are not limited to: nonionics, cationics, ampholytics, zwitterionics, polyhydroxy fatty acid amides, and mixtures thereof. In certain embodiments, the surfactant system may comprise a mixture of anionic surfactant and nonionic surfactant in a weight ratio of anionic: nonionic of from about 50:1 to about 3:1.

Anionic Surfactants—Suitable anionic surfactants may be selected from the group consisting of: linear alkylbenzene sulfonate, alpha olefin sulfonate, paraffin sulfonates, methyl ester sulfonates, alkyl sulfates (abbreviated as "AS"), alkyl alkoxy sulfate, alkyl ethoxy sulfates (abbreviated as "AES"), alkyl sulfonates, alkyl alkoxy carboxylate, alkyl alkoxylated sulfates, sarcosinates, taurinates, and mixtures thereof. An effective amount of anionic surfactant in the detergent compositions described herein may range from about 0.5% to about 90%, from about 5% to about 50%, and alternatively, from about 10 to about 30%, by weight, of the detergent composition.

Nonionic Detergent Surfactants—Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl dialkyl amine oxide, alkyl ethoxylate, alkanoyl glucose amide, alkyl betaines, and mixtures thereof. An effective amount of nonionic surfactant in the detergent compositions described herein may range from about 0.5% to about 90%, from about 5% to about 50%, and alternatively, from about 10 to about 30%, by weight, of the detergent composition.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula:

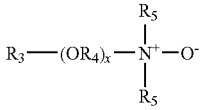

wherein $R_3$ is an alkyl, hydroxyalkyl, or alkyl phenyl group or mixtures thereof containing from about 8 to about 22 carbon atoms; $R_4$ is an alkylene or hydroxyalkylene group containing from about 2 to about 3 carbon atoms or mixtures thereof; x is from 0 to about 3; and each $R_5$ is an alkyl or hydroxyalkyl group containing from about 1 to about 3 carbon atoms or a polyethylene oxide group containing from about 1 to about 3 ethylene oxide groups. The $R_5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{12}$ alkoxy ethyl dihydroxy ethyl amine oxides.

Cationic Surfactants—Cationic detersive surfactants can also be included in detergent compositions of the present invention. Cationic surfactants useful herein are also described in U.S. Pat. No. 4,228,044, Cambre, issued Oct. 14, 1980.

Builders

The detergent compositions may comprise any suitable builder system in any suitable amount. Any conventional builder system is suitable for use herein. In one non-limiting embodiment, a suitable builder may be selected from the group consisting of: phosphates (e.g. orthophosphates, complex phosphates), silicates (e.g. aluminum silicates, metasilicates, sodium silicates, colloidal silicates), carbonates (e.g. soda ash, sodium bicarbonates), and oxygen releasing materials (e.g. sodium perborates, sodium percarbonates), and mixtures thereof. Suitable builders may also include carboxylates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid.

Suitable polycarboxylates builders for use herein include citric acid (e.g. citric acid in the form of a water-soluble salt), derivatives of succinic acid of the formula R—CH(COOH) $CH_2$(COOH) wherein R is $C_{10-20}$ alkyl or alkenyl, and alternatively, a $C_{12-16}$, or wherein R can be substituted with hydroxyl, sulfo sulfoxyl or sulfone substituents. Specific examples include lauryl succinate , myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts. Other suitable polycarboxylates are oxodisuccinates and mixtures of tartrate monosuccinic and tartrate disuccinic acid such as described in U.S. Pat. No. 4,663,071.

Especially for liquid detergent compositions, suitable fatty acid builders include saturated or unsaturated $C_{10-18}$ fatty acids, as well as the corresponding soaps. Saturated species may have from about 12 to about 16 carbon atoms in the alkyl chain. An unsaturated fatty acid may be oleic acid. Other builder systems for liquid compositions may be based on dodecenyl succinic acid and citric acid.

Detergency builder salts are normally included in amounts of from about 3% to about 50%, from about 5% to about 30%, and alternatively, from about 5% to about 25% by weight of the composition.

Enzymes

The detergent compositions may comprise any suitable enzyme in any suitable amount in order to provide cleaning performance benefits. Suitable enzymes include, but are not limited to enzymes selected from the group consisting of: cellulases, hemicellulases, peroxidases, proteases, glucoamylases, amylases, lipases, cutinases, pectinases, xylanases, reductases, oxidases, phenoloxidases, lipoxygenases, ligninases, pullulanases, tannases, pentosanases, malanases, β-glucanases, arabinosidases, and mixtures thereof. In one non-limiting embodiment a detergent composition may comprise a "cocktail" of conventional enzymes like protease, amylase, lipase, cutinase and/or cellulase. Enzymes may be incorporated in the detergent composition at levels from 0.0001% to 2% of active enzyme by weight of the detergent composition.

Optional Adjunct Ingredients

The detergent compositions may comprise any suitable adjunct ingredient in any suitable amount. Suitable amounts can include from about 0.0001% or 0.001% to about any of the following: 1%, 5%, 10%, 15%, 20%, 30%, 40%, 50%, 60%, 70%, 80%, 90%, 95%, or 99.9%.

Suitable adjunct ingredients may include, but are not limited to: enzyme stabilizing systems; buffers (e.g. alkali metal carbonate, alkali metal phosphate, lysine, tri(hydroxymethyl) amino methane); an alkalinity source; nanoparticles; functionalized surface molecules; polymers; polysaccharides; metal ions; proteins; acids; bases; solvents; chelants (e.g. EDTA, EDDS, NTA, citrate, etc.); optical brighteners; soil release agents; wetting agents; abrasives; dispersants; polymeric dispersing agents; thickeners; perfumes; blooming perfumes; fillers; hydrotropes; preservatives; germicides; fungicides; bactericides; colorants such as pigments, dyes, and color speckles; silvercare; mildew control agents; odor controlling agent (e.g. cyclodextrin); insect repellants; anti-corrosive aids; anti-tarnishing agents; solubilizing agents; carriers; electrode maintenance and/or descaling agents; processing aids; pH control agents; bleaching agent; bleach activators; bleach catalysts; suds boosting polymers; salts; and mixtures thereof.

Suitable solvents include, but are not limited to: water, alcohols, glycols, ether alcohols, and mixtures thereof. Specifically, the group may consist of water, glycol, ethanol, glycol ethers, water, and a mixture thereof, and alternatively, propylene carbonate, propylene glycol, tripropyleneglycol n-propyl ether, diethylene glycol n-butyl ether, water, and a mixture thereof. The solvent herein may have a solubility in water of at least about any of the following: 5%, 10%, 12%, 15%, 20%, 30%, 40%, or 50%, by weight of the solution. In another non-limiting embodiment, the detergent composition may comprise from about 5% to about 78 or 80% of a solvent (i.e. glycol ether). The solvent and a partially water-soluble oil may be provided in detergent composition at a ratio of from about 90:1 to about 1:90, about 50:1 to about 1:50, and alternatively, from about 20:1 to about 1:20.

Product Form

The detergent compositions may comprise any suitable product form. Suitable product forms include, but are not limited to: solids, granules, powders, liquids, liquigels, gels, pastes, creams, and combinations thereof. Any suitable dispensing means may be used herein to dispense the detergent composition. Suitable dispensing means include dispensing baskets or cups, bottles (e.g. pump-assisted bottles, squeeze bottles, etc.), mechanical pumps, multi-compartment bottles, paste dispensers, capsules, tablets, multi-phase tablets, coated tablets, single- and/or multi-compartment water-soluble pouches, single- and/or multi-gel packs, and combinations thereof.

Viscosity

A suitable detergent composition may be formulated at any suitable viscosity measured at 20 deg C. with Brookfield DVII+ rheometer. Depending on consumer preferences, suitable detergent compositions herein may be formulated at viscosities greater than about 50, greater than about 100 centipoise, and alternatively from about 100 to about 400 centipoise. For European formulations, it may be desirable for the detergent compositions to be formulated at viscosities of from about 50 to about 800 centipoise.

pH

Suitable detergent compositions described herein may have any suitable pH. A suitable pH for some non-limiting embodiments may be maintained within the range of from about 2 to about 13, from about 2 to about 7, from about 2 to about 6, from about 2 to about 5, from about 2 to about 4, from about 2 to about 3. In other embodiments, the pH may be from about 7 to about 13, from about 8 to about 13, from about 9 to about 13, from about 10 to about 13, from about 11 to about 13, and alternatively from about 12 to about 13.

In one non-limiting embodiment, a detergent composition may be provided as a unit dose (e.g. capsules, tablets, and/or pouches). In certain non-limiting embodiments, a suitable unitized dose of the detergent composition may, for example, contain: from about 15 g to about 60 g; from about 15 g to about 40 g; from about 15 g to about 25 g; and alternatively, from about 20 g to about 25 g of the detergent composition.

A multi-compartment water-soluble pouch may comprise two or more incompatible components (e.g. bleach and enzymes) in separate compartments. The water-soluble pouch may be comprised of two or more water-soluble films defining two or more separate compartments. The two or more films may exhibit different dissolution rates in the wash liquor. One compartment may first dissolve and release a first component into the wash liquor up to 1 minute, up to 2 minutes, up to 3 minutes, up to 5 minutes, up to 8 minutes, up to 10 minutes, and alternatively up to 15 minutes faster in the wash liquor than the other compartment, which houses a second component that may be incompatible with the first component. In another non-limiting embodiment, a multi-phase detergent product may comprise a solid (e.g. granules, capsules, and/or tablets) in one compartment, and in a separate compartment of a multi-compartment water-soluble pouch, a liquid and/or gel.

Process of Manufacture

An aqueous basic or alkaline (pH 9.0) detergent formulation comprising an azo initiator compound (I), a detergent active, and an adjunct ingredient may be prepared as follows. The azo initiator compound (I) is pre-dissolved in an aqueous 1% solution of 2M NaOH to form an azo pre-mix solution. Anionic surfactants (e.g. AES, AS) are then pre-mixed with amine oxide, nonionics, diamine, and suds boosting polymers. A solvent system is prepared comprising polypropylene glycol, sodium cumene sulfonate, ethanol, aqueous NaCl, and water. The azo pre-mix solution is then added to the solvent system. The pH is checked and adjusted with NaOH to bring the aqueous mixture to the proper pH. Dyes, perfumes, thickeners, and/or additional water are then added to finish the detergent composition to the desired aesthetics (e.g. color, consistency, viscosity, etc.). A final pH check is performed. pH adjustment is preformed if necessary with NaOH.

In one non-limiting embodiment, a light duty liquid detergent composition may comprise an azo initiator compound (I) with substituent groups that are stable and soluble within an alkaline pH range (such as from about 8 to about 14). In such a basic media, the substituent groups may have functional groups that will have a pKa range of from about 1 to about 7, and alternatively, form about 2 to about 6. An example of a suitable base soluble azo initiator, VAZO®68, is shown below:

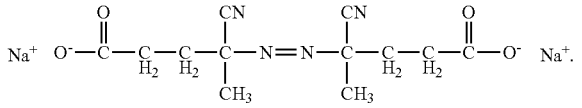

An aqueous neutral (pH 7) detergent formulation comprising an azo initiator compound (I), a detergent active, and an adjunct ingredient is prepared. The azo initiator is pre-dissolved in a solvent system comprising of polypropylene glycol, sodium cumene sulfonate, ethanol and aqueous NaCl. Anionic surfactants (AES, AS) are pre-mixed with amine oxide, nonionics, diamine and suds boosting polymer. The solvent system comprising the pre-mixed neutral azo initiator is added to the anionic surfactant mixture. The pH is checked and adjusted with NaOH or HCl to pH 7.0+/−0.5. Dyes, perfumes, thickeners, and/or additional water are then added to finish the detergent composition to the desired aesthetics (e.g. color, consistency, viscosity, etc.). A final pH check is performed. pH adjustment is preformed if necessary with NaOH or HCl.

In one non-limiting embodiment, a light duty liquid detergent may comprise an azo initiator compound (I) with substituent groups that are stable and soluble within a neutral pH (about 7). Neutral azo initiators may be solubilized in concentrated surfactant formulas. Azo structures having surfactant-like structure with C (carbon) chain lengths from $C_6$ and greater may be readily absorbed into the hydrophobic region of surfactant lamellar phases. Examples of neutral, surfactant-like azo initiators include, but are not limited to:

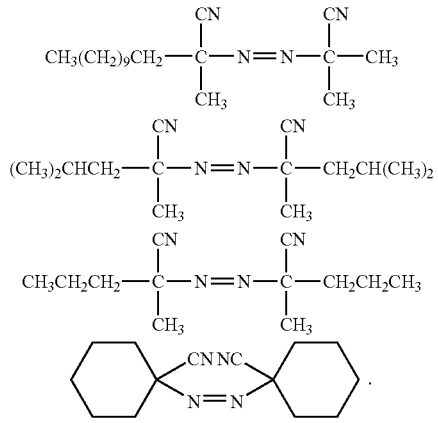

An aqueous acidic (pH 5.5) detergent formulation comprising an azo initiator compound (I), a detergent active, and an adjunct ingredient is prepared. The azo initiator is pre-dissolved in aqueous 0.5% solution of 1M HCl. Anionic surfactants (AES, AS) are pre-mixed with amine oxide, and nonionics. A solvent system is prepared and consists of polypropylene glycol, sodium cumene sulfonate, ethanol and aqueous NaCl. The solvent system is mixed with the surfactant pre-mixture. The acidic azo pre-mix solution is then added to the surfactant-solvent system mixture. The pH is checked and adjusted with HCl or NaOH. Dyes, perfumes, thickeners, and/or additional water are then added to finish the detergent composition to the desired aesthetics (e.g. color, consistency, viscosity, etc.). A final pH check is performed. pH adjustment is preformed if necessary with HCl or NaOH.

In one non-limiting embodiment, a light duty liquid detergent may comprise an azo initiator compound (I) with substituent groups that are stable and soluble within an acidic pH range (such as from about 1 to about 7). In such an acidic media, the substituent groups may comprise functional groups that will have a pKa range of about 7 to about 14, and alternatively, of about 8 to about 11. Examples of suitable azo initiator compounds soluble in the acidic pH range include, but are not limited to: imidazoyl and guanidyl, as represented in the formulae below, which are available from DuPont as VAZO® 44 and VAZO® 56, respectively:

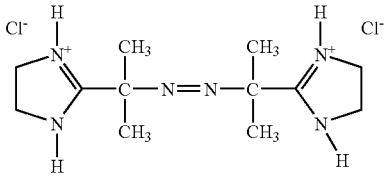

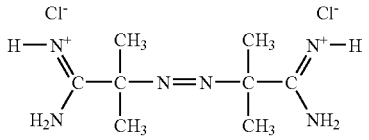

In another non-limiting embodiment, a non-aqueous detergent formulation comprising an azo initiator compound (I), a detergent active, and an adjunct ingredient is provided. The non-aqueous detergent formulation may be prepared by pre-dissolving the azo initiator in methylene chloride. Anionic surfactants (AES, AS) are premixed with amine oxide and extracted into methylene chloride. The aqueous layer of amine oxide and anionic mix is discarded and methylene chloride extract is combined with the pre-dissolved methlene chloride solution of azo initiator. The combined mixture of azo initiator anionic and amine oxide in methlyene chloride is evaporated in vacuum to totally remove the methylene chloride solvent from the combined mixture. The resulting liquid residue is then dissolved in ethanol, polypropylene glycol and nonionic surfactants (NEODOL 91-8™). Dyes, perfumes and additional ethanol are added to finish the detergent composition to the desired aesthetics.

EXAMPLES

The following examples are illustrative of the present invention, but are not meant to limit or otherwise define its scope. All parts, percentages and ratios used herein are expressed as percent weight unless otherwise specified. All levels are quoted as % by weight of the composition. Table II shows typical detergent compositions with varying pH (basic, neutral, and acidic).

TABLE II

| Composition | Basic | Neutral | Acidic |
|---|---|---|---|
| AES | 9.0 | 10.0 | 9.0 |
| AS | 17.5 | 19.0 | 17.5 |
| Amine Oxide | 6.0 | 6.5 | 6.0 |
| Nonionic ($C_{10}EO_9$) | 2.0 | 2.0 | 2.0 |
| 1,3-cyclohexane bis methylamine | 0.5 | 0.5 | 0.5 |
| Poly DMAM | 0.2 | 0.2 | 0.2 |
| Vazo 68 | 2.0 | — | — |
| Vazo 52 | — | 2.0 | — |
| Vazo 56 | — | — | 2.0 |
| Ethanol | 3.5 | 8.0 | 3.5 |
| Polypropylene glycol | 1.5 | 3.0 | 1.5 |
| Sodium cumene sulfonate | 1.0 | 1.0 | 1.0 |
| NaCl | 1.0 | 1.0 | 1.0 |
| NaOH | 0.10 | — | — |
| HCl | — | — | 0.05 |
| Water | balance | balance | balance |

Tables III-V provide non-limiting product formulations of suitable detergent compositions for treating plastic carotenoid stained tableware.

TABLE III

Liquid/Gel Detergent Composition

| | EXAMPLES | | | | | |
|---|---|---|---|---|---|---|
| INGREDIENTS | 2 | 3 | 4 | 5 | 6 | 7 |
| VAZO ® 68[1] | 0.5 | 1.0 | 2.0 | 4.0 | 0.5 | 2.0 |
| STPP/SKTP/KTPP | 17.5 | 17.5 | 17.5 | 17.5 | 22.0 | 22.0 |
| Sodium hydroxide | 1.9 | 1.9 | 1.9 | 1.9 | — | — |
| Potassium hydroxide | 3.9 | 3.9 | 3.9 | 3.9 | 5.8 | 5.8 |
| Sodium silicate | 7.0 | 7.0 | 7.0 | 7.0 | — | — |
| $H_2SO_4$ | — | — | — | — | 3.9 | 3.9 |
| Thickener | 1.0 | 1.0 | 1.0 | 1.0 | 1.2 | 1.2 |
| Sodium hypochlorite | 1.2 | 1.2 | 1.2 | 1.2 | — | — |
| Nonionic surfactant | — | — | — | — | 1.0 | 1.0 |
| Protease enzyme | — | — | — | — | 0.6 | 0.6 |
| Amylase enzyme | — | — | — | — | 0.2 | 0.2 |
| Enzyme stabilizing agents | — | — | — | — | 3.5 | 3.5 |
| Water and minors[2] | Balance | Balance | Balance | Balance | Balance | Balance |
| pH (1% Solution) | 11.7 | 11.7 | 11.7 | 11.7 | 9 | 9 |

[1]Azo initiator compound (I) for basic or alkaline compositions from Dupont Chemicals of Wilmington, DE.
[2]Balance to 100% can, for example, include dyes, perfumes, speckles, corrosion inhibitor, dishcare agent, fillers, solvents, polymers, and additional water.

TABLE IV

| | Granular Or Powder Detergent Composition | | | | | | |
|---|---|---|---|---|---|---|---|
| | EXAMPLES | | | | | | |
| INGREDIENTS | 8 | 9 | 10 | 11 | 12 | 13 | 14 |
| Symmetrical Azo Initiator Compound[1] | 1.0 | 1.0 | 1.0 | 1.0 | 1.0 | 1.0 | 1.0 |
| STPP/SKTP/KTPP | 20.0 | 20.0 | 23.0 | 23.0 | 23.0 | 28.0 | — |
| Sodium citrate | — | — | — | — | — | — | 25 |
| Hydrozincite | — | 0.05 | 0.10 | 0.15 | 0.5 | 0.1 | 0.1 |
| Sodium carbonate | 30.0 | 30.0 | 30.0 | 30.0 | 30.0 | 30.0 | 30.0 |
| Sodium silicate | 5.5 | 5.5 | 5.5 | 5.5 | 5.5 | 5.5 | 5.5 |
| Surfactant | 0.9 | 0.9 | 0.9 | 0.9 | 0.9 | 1.8 | 0.9 |
| Polymer Dispersant[2] | — | — | — | — | — | 3.3 | — |
| Sodium perborate | 4.3 | 4.3 | 4.3 | 4.3 | 4.3 | 4.3 | 4.3 |
| Bleach catalyst[3] | 0.004 | 0.004 | 0.004 | 0.004 | 0.004 | 0.004 | 0.004 |
| Protease enzyme | 0.6 | 0.6 | 0.6 | 0.6 | 0.6 | 1.0 | 0.25 |
| Amylase enzyme | 0.2 | 0.2 | 0.2 | 0.2 | 0.2 | 0.2 | 0.13 |
| Water and minors[4] | Balance | Balance | Balance | Balance | Balance | Balance | Balance |
| pH (1% Solution) | 10 | 10 | 10 | 10 | 10 | 10 | 10 |

[1]Azo initiator compound (I' and/or I'') for basic or alkaline compositions.
[2]PEI 189 $EO_{15-18}$ according to U.S. Pat. No. 4,597,898 Vander Meer, issued Jul. 1, 1986.
[3]5,12-dimethyl-1,5,8,12-tetraaza-bicyclo[6.6.2]hexadecanemanganese (II) chloride.
[4]Balance to 100% can, for example, include dyes, perfumes, speckles, corrosion inhibitor, dishcare agent, fillers, solvents, and other polymers.

TABLE V

| | Detergent Compositions in Water-Soluble Pouches[4] | | | | |
|---|---|---|---|---|---|
| | EXAMPLES | | | | |
| INGREDIENTS | 15 | 16 | 17 | 18 | 19 |
| VAZO ® 68[1] | 1.0 | 1.0 | 1.0 | 1.0 | 1.0 |
| STPP/SKTP/KTPP | 33.0 | 33.0 | 33.0 | 33.4 | 30.7 |
| Sodium citrate | — | — | — | — | 33.6 |
| Sodium carbonate | 19.0 | 19.0 | 28.0 | 26.0 | — |
| Sodium silicate | 7.8 | 7.8 | 4.2 | 4.3 | — |
| Surfactant | 3.2 | 3.2 | 6.5 | 2.3 | 0.5 |
| Dispersant polymer | — | — | 4.3 | — | — |
| NaDCC/sodium hypochloride | — | — | — | 1.1 | — |
| Sodium perborate | 12.8 | 12.8 | 9.3 | — | — |
| Bleach catalyst[2] | 0.013 | 0.013 | 1.4 | — | — |
| Protease enzyme | 2.2 | 2.2 | 0.3 | — | 1.3 |
| Amylase enzyme | 1.7 | 1.7 | 0.9 | — | 0.2 |
| Water and minors[3] | Balance | Balance | Balance | Balance | Balance |
| pH (1% Solution) | 10 | 10 | 10 | 10 | 10 |

[1]Azo initiator compound (I) for basic or alkaline compositions from Dupont Chemicals of Wilmington, DE.
[2]5,12-dimethyl-1,5,8,12-tetraaza-bicyclo[6.6.2]hexadecanemanganese (II) chloride.
[3]Balance to 100% can, for example, include dyes, perfumes, speckles, corrosion inhibitor, dishcare agent, fillers, solvents, polymers, and additional water.
[4]Single-compartment and/or multiple-compartmented water-soluble pouches comprised of partially hydrolyzed, water-soluble polyvinyl alcohol film.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A detergent composition comprising:

a) at least 1% of a compound having one or more of the following formulas:

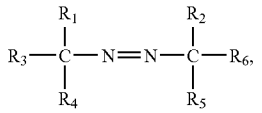

(I)

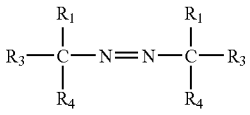

(I')

-continued (I″)

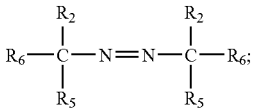

wherein functional groups $R_1$ and $R_2$ are independently either H, a hydrocarbyl having up to 30 carbon atoms, an electron releasing group, or an electron withdrawing group; wherein functional groups $R_3$, $R_4$, $R_5$, and $R_6$ are independently either H or a hydrocarbyl; and wherein when paired, functional groups $R_3$ and $R_4$ and/or $R_5$ and $R_6$ independently comprise at least 10 carbon atoms b) a detergent active comprising from 0.5% to about 90%, by weight of a nonionic surfactant; and c) optionally, an adjunct ingredient.

2. The detergent composition according to claim 1, comprising an electron releasing group wherein said electron releasing group is selected from the group consisting of:

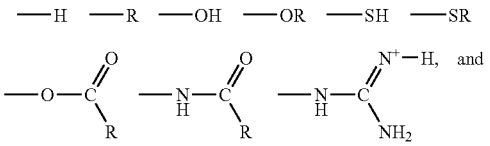

combinations thereof; wherein R is a hydrocarbyl having greater than about 1 carbon atom; X is a halide; and wherein M is a metal.

3. The detergent composition according to claim 1, comprising an electron withdrawing group wherein said electron withdrawing group is selected from the group consisting of:

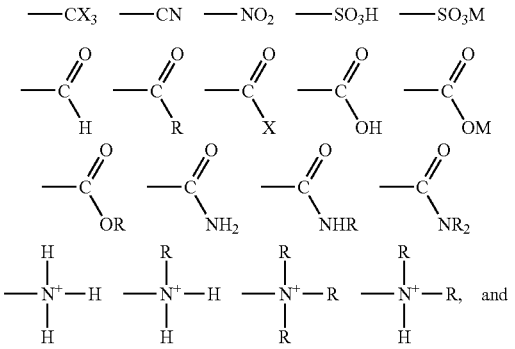

combinations thereof; wherein R is a hydrocarbyl having greater than about 1 carbon atom; X is a halide; and wherein M is a metal.

4. The detergent composition according to claim 1, wherein said functional groups $R_1$ or $R_2$ comprise 2, 4, 6, 8, 10, 12, 14, 16, 18, 20, 22, 24, or 26 carbon atoms.

5. The detergent composition according to claim 1, wherein said paired functional groups $R_3$ and $R_4$ and/or $R_5$ and $R_6$ independently comprise from 10 to about 30 carbon atoms.

6. The detergent composition according to claim 1, wherein said compound (I) is asymmetrical.

7. The detergent composition according to claim 1, wherein said compound (I) has a ClogP value of greater than about 0.5.

8. The detergent composition according to claim 1 wherein said compound (I) has a molecular weight in the range of from about 50 to about 1500 grams/mole.

9. The detergent composition according to claim 1, wherein said detergent active consisting of additional a surfactant system comprising a surfactant selected from the group comprising nonionic surfactants, anionic surfactants and mixtures thereof.

10. The detergent composition according to claim 9, wherein said surfactant system comprises a surfactant selected from the group consisting of alkyl sulfates, alkyl alkoxy sulfates, alkyl sulfonates, alkyl alkoxy sulfonates, amine oxides, alkyl aryl sulfonates, alpha olefin sulfonates, methyl ester sulfonates, and mixtures thereof.

11. The detergent composition according to claim 9 wherein said surfactant system is a mixture of anionic surfactant and nonionic surfactant in a weight ratio of anionic: nonionic of from about 50:1 to about 3:1.

12. A detergent composition according to claim 1 wherein said detergent active further comprises an enzyme.

13. The detergent composition according to claim 12 wherein said enzyme is selected from the group consisting of a protease enzyme or an amylase enzyme.

14. The detergent composition according to claim 1 wherein said detergent active further comprises a builder selected from the group consisting of: phosphates, silicates, carbonates, carboxylates, polycarboxylates and mixtures thereof.

15. The detergent composition according to claim 1 further comprising a solvent wherein said solvent is present in an amount of about 0.0001% to about 80% by weight of the detergent composition.

16. The detergent composition according to claim 15, wherein said solvent is selected from the group consisting of ethanol, glycol ethers, propylene carbonates, propylene and polypropylene glycols, water, and mixtures thereof.

17. The detergent composition according to claim 1, wherein said composition has a pH of from about 2 to about 13, as measured by a 1% aqueous solution.

18. The detergent composition according to claim 1, wherein said composition is a liquid having a viscosity of greater than about 50 centipoise.

19. The detergent composition according to claim 1, wherein said composition is provided in the form of a water-soluble pouch, multi-compartmented water-soluble pouch, and combinations thereof.

20. A method of at least partially removing carotene stains on plastic, said method comprising the steps of:

(a) obtaining the dishwashing composition of claim 1; and (b) applying the dishwashing composition to a carotene-stained plastic article.

* * * * *

UNITED STATES PATENT AND TRADEMARK OFFICE

CERTIFICATE OF CORRECTION

PATENT NO. : 7,713,920 B2
APPLICATION NO. : 11/639002
DATED : May 11, 2010
INVENTOR(S) : Ford et al.

It is certified that error appears in the above-identified patent and that said Letters Patent is hereby corrected as shown below:

Column 2
Line 13, delete "$P_4$" and insert --$R_4$--.

Column 3
Line 29, delete "$P_4$" and insert --$R_4$--.
Line 39, delete "$P_4$" and insert --$R_4$--.
Line 42, delete "$P_4$" and insert --$R_4$--.

Signed and Sealed this
Twenty-fifth Day of October, 2011

David J. Kappos
*Director of the United States Patent and Trademark Office*